US011692300B2

(12) United States Patent
Vaive

(10) Patent No.: US 11,692,300 B2
(45) Date of Patent: Jul. 4, 2023

(54) LAUNDRY TREATING APPLIANCE FOR DRYING LAUNDRY

(71) Applicant: WHIRLPOOL CORPORATION, Benton Harbor, MI (US)

(72) Inventor: Nicholas B. Vaive, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 106 days.

(21) Appl. No.: 17/316,038

(22) Filed: May 10, 2021

(65) Prior Publication Data

US 2021/0262152 A1 Aug. 26, 2021

Related U.S. Application Data

(63) Continuation of application No. 16/586,060, filed on Sep. 27, 2019, now Pat. No. 11,028,527.

(51) Int. Cl.
*D06F 58/30* (2020.01)
*D06F 29/00* (2006.01)
(Continued)

(52) U.S. Cl.
CPC ..... *D06F 58/30* (2020.02); *D06F 29/005* (2013.01); *D06F 29/02* (2013.01); *D06F 49/006* (2013.01);
(Continued)

(58) Field of Classification Search
CPC ..... D06F 58/26; D06F 58/30; D06F 58/38; D06F 29/005; D06F 29/02; D06F 49/08;
(Continued)

(56) References Cited

U.S. PATENT DOCUMENTS 4,891,892 A ‡ 1/1990 Narang ..... D06F 58/22 34/86
5,038,586 A ‡ 8/1991 Nukaga ..... D06F 37/225 68/12.01
(Continued)

FOREIGN PATENT DOCUMENTS

CN 1837453 A 9/2006
DE 102013210129 A1 12/2014
(Continued)

OTHER PUBLICATIONS

European Search Report for Counterpart EP20197938.2, dated Jan. 26, 2021.‡
(Continued)

*Primary Examiner* — Stephen M Gravini
(74) *Attorney, Agent, or Firm* — McGarry Bair PC

(57) ABSTRACT

A method of operating a laundry treating appliance with a treating chamber for treating a load of laundry the method comprising supplying a rinse to the treating chamber during a rinse cycle, rotating the treating chamber at a tumbling speed, spinning the treating chamber in an extraction cycle to remove excess moisture from the load of laundry, sensing a parameter indicative of a remaining moisture content value in the load of laundry, comparing the remaining moisture content value to a pre-determined remaining moisture content value.

20 Claims, 4 Drawing Sheets

(51) Int. Cl.

| | |
|---|---|
| ***D06F 29/02*** | (2006.01) |
| ***D06F 49/00*** | (2006.01) |
| ***D06F 49/08*** | (2006.01) |
| ***D06F 58/26*** | (2006.01) |
| ***D06F 105/46*** | (2020.01) |
| ***D06F 103/00*** | (2020.01) |
| ***D06F 103/34*** | (2020.01) |
| ***D06F 103/44*** | (2020.01) |
| ***D06F 103/04*** | (2020.01) |
| ***D06F 103/02*** | (2020.01) |
| ***D06F 103/10*** | (2020.01) |
| ***D06F 58/38*** | (2020.01) |

(52) U.S. Cl.
CPC ..... *D06F 49/08* (2013.01); *D06F 58/26* (2013.01); *D06F 58/38* (2020.02); *D06F 2103/00* (2020.02); *D06F 2103/02* (2020.02); *D06F 2103/04* (2020.02); *D06F 2103/10* (2020.02); *D06F 2103/34* (2020.02); *D06F 2103/44* (2020.02); *D06F 2105/46* (2020.02)

(58) Field of Classification Search
CPC ..... D06F 2105/46; D06F 2103/00; D06F 2103/34; D06F 2103/44; D06F 2103/04; D06F 2103/02; D06F 2103/10
USPC ..... 34/337
See application file for complete search history.

(56) References Cited

U.S. PATENT DOCUMENTS

| | | | | | |
|---|---|---|---|---|---|
| 5,207,764 | A ‡ | 5/1993 | Akabane | D06F 35/007 | 68/20 |
| 6,446,357 | B2 ‡ | 9/2002 | Woerdehoff | D06F 58/30 | 34/491 |
| 7,300,468 | B2 ‡ | 11/2007 | Wright | D06F 43/08 | 8/142 |
| 7,627,920 | B2 ‡ | 12/2009 | Wong | D06F 39/008 | 8/159 |
| 7,651,532 | B2 ‡ | 1/2010 | Wright | D06F 35/006 | 8/142 |
| 7,765,628 | B2 ‡ | 8/2010 | Wong | D06F 35/006 | 8/158 |
| 7,941,885 | B2 ‡ | 5/2011 | Wong | D06F 35/006 | 8/158 |
| 8,276,230 | B2 ‡ | 10/2012 | Kim | D06F 35/00 | 8/149.3 |
| 8,347,520 | B2 ‡ | 1/2013 | Kuwabara | D06F 58/206 | 34/73 |
| 8,533,881 | B2 ‡ | 9/2013 | Brockman | D06F 58/36 | 8/158 |
| 8,832,966 | B2 ‡ | 9/2014 | Ashrafzadeh | G01N 21/55 | 34/491 |
| 8,919,009 | B2 ‡ | 12/2014 | Colombo | D06F 58/30 | 34/413 |
| 9,062,407 | B2 ‡ | 6/2015 | Kim | D06F 37/203 | |
| 9,080,273 | B2 ‡ | 7/2015 | Moschutz | D06F 35/006 | |
| 9,322,125 | B2 ‡ | 4/2016 | Brockman | D06F 35/006 | |
| 9,353,475 | B2 ‡ | 5/2016 | Ashrafzadeh | D06F 58/02 | |
| 9,359,713 | B2 ‡ | 6/2016 | Kang | D06F 35/006 | |
| 9,644,310 | B2 | 5/2017 | Cimetta et al. | | |
| 9,828,715 | B2 ‡ | 11/2017 | Kwon | D06F 39/04 | |
| 10,006,160 | B2 ‡ | 6/2018 | Brockman | D06F 33/36 | |
| 10,450,692 | B2 ‡ | 10/2019 | Wu | D06F 58/206 | |
| 10,544,535 | B2 ‡ | 1/2020 | Jiang | D06F 17/12 | |
| 10,676,859 | B2 ‡ | 6/2020 | Vitali | D06F 58/30 | |
| 11,028,527 | B2 * | 6/2021 | Vaive | D06F 33/60 | |
| 11,255,042 | B2 * | 2/2022 | Choung | H04B 7/0413 | |
| 11,268,234 | B2 * | 3/2022 | Jang | D06F 33/00 | |
| 2011/0289696 | A1 ‡ | 12/2011 | Colin | D06F 58/206 | 8/137 |
| 2013/0139402 | A1 ‡ | 6/2013 | Hong | D06F 58/04 | 34/427 |
| 2014/0021140 | A1 ‡ | 1/2014 | Hwang | D06F 33/00 | 210/739 |
| 2014/0325865 | A1 ‡ | 11/2014 | Wisherd | F26B 11/0495 | 34/255 |
| 2018/0230638 | A1 ‡ | 8/2018 | Brockman | D06F 35/006 | |
| 2020/0115839 | A1 ‡ | 4/2020 | Kim | D06F 39/088 | |

FOREIGN PATENT DOCUMENTS

| | | | | |
|---|---|---|---|---|
| DE | 102013210129 | A1 ‡ | 12/2014 | D06F 33/32 |
| EP | 2607536 | A1 | 6/2013 | |
| EP | 2607536 | A1 ‡ | 6/2013 | D06F 35/007 |
| EP | 2735637 | A1 ‡ | 5/2014 | D06F 58/206 |
| EP | 2735637 | A1 | 5/2014 | |
| EP | 3004448 | B1 | 7/2017 | |
| EP | 3004448 | B1 ‡ | 7/2017 | D06F 33/32 |
| EP | 3450608 | B1 ‡ | 1/2020 | D06F 23/02 |
| EP | 3450608 | B1 | 1/2020 | |
| GB | 1475130 | A ‡ | 6/1977 | D06F 25/00 |
| GB | 1475130 | A | 6/1977 | |
| WO | 2016144794 | A1 | 9/2016 | |
| WO | WO-2016144794 | A2 ‡ | 9/2016 | D06F 23/06 |
| WO | 2017121393 | A1 | 7/2017 | |
| WO | WO-2017121393 | A1 ‡ | 7/2017 | D06F 33/00 |
| WO | 2019045446 | A1 | 3/2019 | |
| WO | WO-2019045446 | A1 ‡ | 3/2019 | D06F 37/10 |

OTHER PUBLICATIONS

Chinese Patent Office, Office Action re Corresponding Application No. 202010854152.3, dated Jul. 11, 2022, 10 pages, China.

* cited by examiner
‡ imported from a related application

LAUNDRY TREATING APPLIANCE FOR DRYING LAUNDRY

CROSS-REFERENCE TO RELATED APPLICATIONS

This application is a continuation of U.S. patent application Ser. No. 16/586,060 filed Sep. 27, 2019, now U.S. Pat. No. 11,028,527, issued Jun. 8, 2021, which is hereby LAUNDRY TREATING APPLIANCE FOR DRYING LAUNDRY incorporated herein by reference in its entirety.

BACKGROUND

Laundry treating appliances, such as washing machines, combination washer/dryers, refreshers, and non-aqueous systems, can have a configuration based on a rotating drum that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. In addition, hot air, cold air, or a mixture thereof can be supplied to the treating chamber in accordance with the cycle of operation and via an air flow assembly.

BRIEF SUMMARY

In one aspect, the present disclosure relates to a method of extracting liquid from a laundry load residing in a rotating drum of a laundry treating appliance during a rinsing phase of operation, the method comprising: a) supplying water into the drum; b) heating the supplied water to a predetermined temperature to form hot water; c) rotating the drum at a tumbling speed in the presence of the hot water; d) rotating the drum at a spinning speed; e) sensing a parameter indicative of a residual moisture content of the laundry load; and f) repeating at least d) and e) until the sensed parameter indicates a residual moisture content below a predetermined threshold.

In another aspect, the present disclosure relates to a method of operating a laundry treating appliance with a treating chamber for treating a load of laundry the method comprising heating a water supply to a predetermined temperature to form a hot water rinse; supplying the hot water rinse to the treating chamber during a hot rinse cycle; rotating the treating chamber at a tumbling speed; spinning the treating chamber in an extraction cycle to remove excess moisture from the load of laundry; sensing a parameter indicative of a remaining moisture content value in the load of laundry; comparing the remaining moisture content value to a pre-determined remaining moisture content value; and repeating the extraction cycle until the remaining moisture content value is less than the pre-determined remaining moisture content value.

DETAILED DESCRIPTION

Aspects of the disclosure relate to a method of removing moisture from a load of laundry in a combination washing and drying machine after a wash cycle and before a drying cycle. Laundry treating appliances can be provided with structures and functionality both for washing and drying laundry items within a single appliance. In the case of such a combination washing and drying appliance, in addition to the components provided in a traditional washing machine, additional components for drying laundry items are also provided within the appliance. Non-limiting examples of such drying components include an air flow pathway, including an air inlet and an air outlet to the tub interior, a condenser, a blower, a heating element, and a manifold.

In traditional combination washing and drying machines, a drying cycle can expend extra energy drying clothes that remain too damp from the washing cycle. This can result in poor drying performance and wasted energy resources. The present disclosure sets forth a combination washing and drying machine including an intermittent step between a washing cycle and a drying cycle of the combination washing and drying machine. To summarize, at the end of a washing cycle during a rinse cycle near the end of the washing cycle, hot water is introduced. Increasing the temperature of the rinse cycle enables an increased water extraction capability during the spin cycle. The remaining moisture content (RMC) of the load of laundry is checked to ensure it is below a certain threshold before the combination washing and drying machine moves into a drying cycle.

Figure 1:
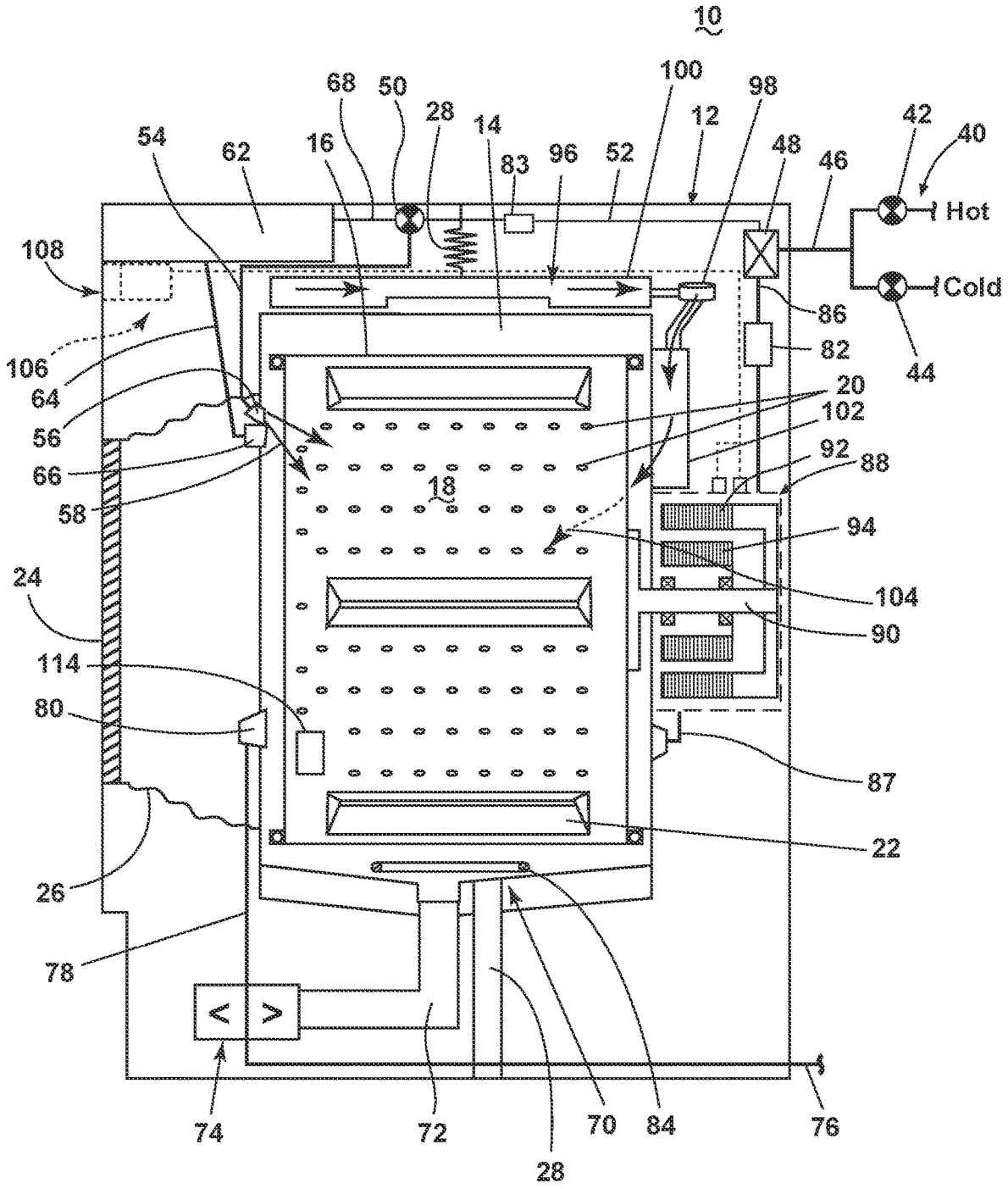
FIG. 1 illustrates a schematic cross-sectional view of a laundry treating appliance in the form of a combination washing and drying machine having an air flow assembly according to an aspect of the present disclosure.

FIG. 1 is a schematic cross-sectional view of a laundry treating appliance according to an aspect of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the load of laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The exemplary laundry treating appliance of FIG. 1 is illustrated as a horizontal axis combination washing and drying machine 10, which can include a structural support system comprising a cabinet 12 which defines a housing within which a laundry holding system resides. While illustrated as a combination washing and drying machine 10 it should be understood that the method as described herein can be implemented in a stand-alone washing machine or a stand-alone dryer. The cabinet 12 can be a housing having a chassis and/or a frame, to which decorative panels can or cannot be mounted, defining an interior enclosing component typically found in a conventional washing machine, such as motors, pumps, fluid lines, controls, sensors, transducers, and the like. Such components will not be described further herein except as necessary for a complete understanding of the present disclosure.

The laundry holding system comprises a tub 14 dynamically suspended within the structural support system of the cabinet 12 by a suitable suspension system 28 and a drum 16 provided within the tub 14, the drum 16 defining at least a portion of a laundry treating chamber 18. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated. At least one lifter 22 can extend from a wall of the drum 16 to lift the laundry load received in the treating chamber 18 while the drum 16 rotates.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The combination washing and drying machine 10 can further comprise a washing circuit which can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid 58 into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The combination washing and drying machine 10 can also be provided with a dispensing system for dispensing treating chemistry to the treating chamber 18 for use in treating the load of laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the load of laundry within.

The liquid supply and/or recirculation and drain system can be provided with a heating system which can include one or more devices for heating laundry and/or liquid supplied to the tub 14, such as a steam generator 82, an inline heater 83 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The motor 88 can rotate the drum 16 at various speeds in opposite rotational directions. In particular, the motor 88 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the at least one lifter 22. Typically, the force applied to the fabric items at the tumbling speeds is less than about 1G. Alternatively, the motor 88 can rotate the drum 16 at spin speeds wherein the fabric items rotate with the drum 16 without falling. The spin speeds can also be referred to as satellizing speeds or sticking speeds. Typically, the force applied to the fabric items at the spin speeds is greater than or about equal to 1G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The combination washing and drying machine 10 can further include a drying system 96 that can be a closed loop or an open loop circuit. A closed loop system is illustrated where the drying system 96 can include a blower 98, a condenser 100, and a heating element 102. The condenser 100 can be provided with a condenser drain conduit (not shown) that fluidly couples the condenser 100 with the pump 74 and the drain conduit 76. Condensed liquid collected within the condenser 160 can flow through the condenser drain conduit to the pump 74, where it can be provided to the recirculation and drain system. In an exemplary aspect, the drying system 96 can be provided adjacent an upper portion of the tub 14, though it will be understood that the drying system 96 need not be provided adjacent an upper portion of the tub 14, and can be provided at any suitable location adjacent the tub 14. It is further contemplated that an open loop circuit is implemented where air is heated, passes through the drum 16 and is exhausted out of the combination washing and drying machine 10, in which case a condenser 100 is not necessary. Drying air 104 can be introduced through the front of the drum 16 or via the back of the drum 16 as illustrated.

The combination washing and drying machine 10 also includes a control system for controlling the operation of the combination washing and drying machine 10 to implement one or more cycles of operation. The control system can include a controller 106 located within the cabinet 12 and a user interface 108 that is operably coupled with the controller 106. The user interface 108 can include one or more knobs, dials, switches, displays, touch screens and the like for communicating with the user, such as to receive input and provide output. The user can enter different types of information including, without limitation, cycle selection and cycle parameters, such as cycle options.

The controller 106 can include the machine controller and any additional controllers provided for controlling any of the components of the washing machine 10. For example, the controller 106 can include the machine controller and a motor controller. Many known types of controllers can be used for the controller 106. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
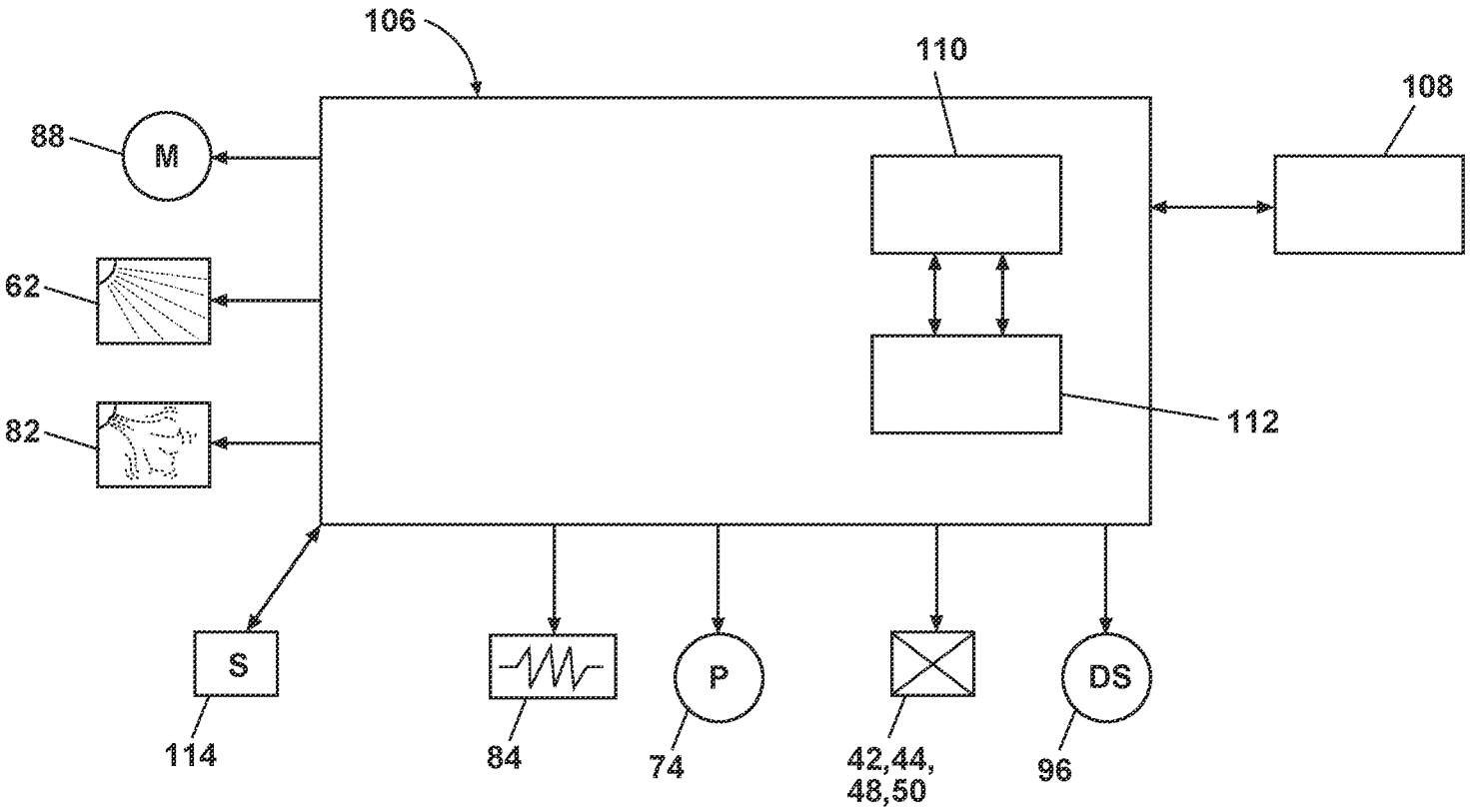
FIG. 2 illustrates a schematic of a control system of the laundry treating appliance of FIG. 1 according to an aspect of the present disclosure.

As illustrated in FIG. 2, the controller 106 can be provided with a memory 110 and a central processing unit (CPU) 112. The memory 110 can be used for storing the control software that is executed by the CPU 112 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 110 can also be used to store information, such as a database or table, and to store data received from one or more components of the combination washing and drying machine 10 that can be communicably coupled with the controller 106. The database or table can be used to store the various operating parameters for the one or more cycles of operation, including factory default values for the operating parameters and any adjustments to them by the control system or by user input.

The controller 106 can be operably coupled with one or more components of the combination washing and drying machine 10 for communicating with and controlling the operation of the component to complete a cycle of operation. For example, the controller 106 can be operably coupled with the motor 88, the pump 74, the treating chemistry dispenser 62, the steam generator 82, the sump heater 84, and the drying system 96 to control the operation of these and other components to implement one or more of the cycles of operation.

The controller 106 can also be coupled with one or more sensors 114 provided in one or more of the systems of the washing machine 10 to receive input from the sensors, which are known in the art and illustrated in FIG. 1 in a lower portion of the treating chamber 18 for exemplary purposes only. Non-limiting examples of sensors 114 that can be communicably coupled with the controller 106 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
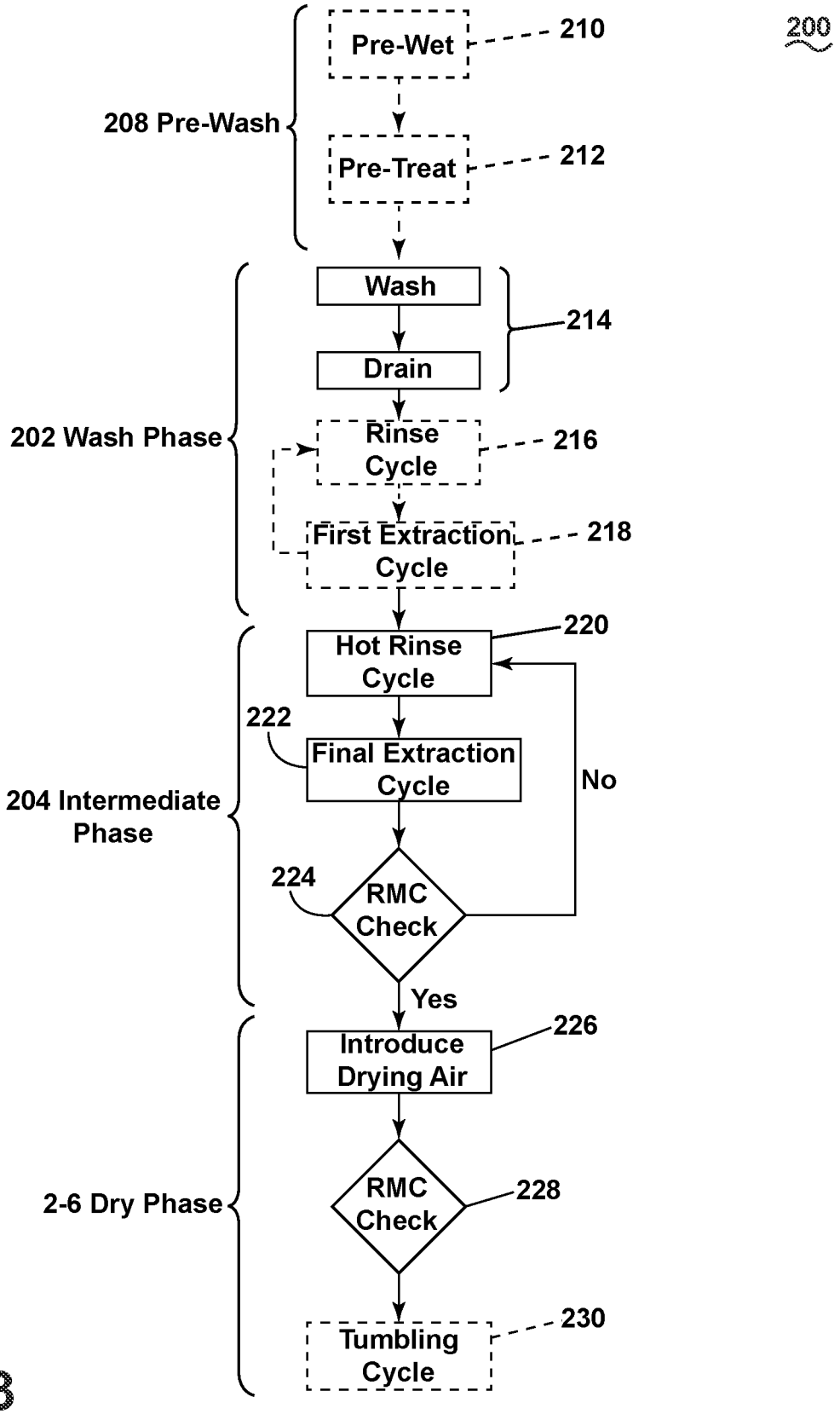
FIG. 3 is a flow diagram illustrating a method of operating the laundry treating appliance of FIG. 1.

Referring now to FIG. 3, a method 200 of operating a laundry treating appliance, by way of non-limiting example the combination washing and drying machine 10 described herein is illustrated. The method is illustrated with at least three main phases, a wash phase 202, an intermediate phase 204, and a drying phase 206, though it is contemplated that the method can include only the wash and intermediate phases 202, 204 or only the intermediate and the drying phases 204, 206 depending on what laundry treating appliance the method is implemented in. It is further contemplated that the method can include a pre-wash phase 208 which can occur prior to the wash phase 202. The pre-wash phase 208 can include a pre-wetting step 210 and/or a pre-treat step 212 where the load of laundry is treated with a treating chemistry, by way of non-limiting example a dye fixative. It should be understood that the pre-wash phase 208 can include any number of steps prior to washing the load of laundry in the wash phase 202.

The wash phase 202 can include a main wash cycle 214 where at least one treating chemistry is dispensed into the treating chamber 18 for washing the load of laundry. Upon completion of washing the load of laundry, wash water can be drained from the treating chamber 18. It should be understood that numerous steps can be associated with the main wash cycle 212 including dispensing a treating chemistry and/or liquid into the treating chamber numerous times and draining the wash water numerous times.

The wash phase 202 can further include a rinse cycle 216 occurring after the main wash cycle 212 where new water is added to the treating chamber 18. The rinse cycle 216 can include a single rinse, where water is supplied to rinse the load of laundry followed spinning the drum to extract the water. It is also contemplated that multiple rinses can occur to ensure all of the treating chemistry is removed from the load of laundry to form rinsed laundry. To enable multiple rinses, the method 200 can include a first extraction cycle 218 including spinning the load of laundry to facilitate the extraction of liquid from the load of laundry. The liquid can subsequently be drained from the sump 70. The first extraction cycle 218 can include different levels of extraction, i.e. different rotational speeds, for moving liquid out of the treating chamber 18 prior to entering the rinse cycle 216 again for a subsequent rinse.

Upon completion of the wash phase 202, an intermediate phase 204 can commence. The intermediate phase includes heating a water supply to form a hot water rinse for a hot rinse cycle 220. The water supply can range in temperature from at least 15° C. (~60° F.) to 55° C. (~130° F.). By way of non-limiting example the hot water valves 42 can supply hot water with a temperature of 55° C. and the cold water valve 44 can supply cold water with a temperature of 15° C. The hot rinse for the hot rinse cycle 220 can therefore utilize hot water with the hot water valve 42 at 100% on supplying a hot rinse of less than or equal to 55° C. It is further contemplated that heating the water supply entails heating a cold water supply with a heater, by way of non-limiting example by utilizing the steam generator 82, inline heater 83 and/or the sump heater 84 as described herein. An adjustment can occur with regards to material and clothes load temperatures based on heat transfer from the hot rinse. These temperatures can vary, they should be between greater than 15° C. and less than or equal to 55° C.

A final extraction cycle 222 with the drum spinning to ensure maximum extraction of liquid from the load of laundry. It is contemplated that the drum can rotate with higher speeds than during the first extraction cycle 218. However, the introduction of hot water to the treating chamber 18 increases the energy of the water molecules in the load of laundry which increases the propensity for the water molecules to leave the treating chamber 18. This intermediate phase 204, therefore, does not require maximum rotational speeds to achieved a pre-determined remaining moisture content (RMC) when compared to the wash phase 202 without including the subsequent hot rinse cycle 220.

The intermediate phase 204 further includes an intermediate RMC check at 224 upon completion of the final extraction cycle 222. Determining an RMC includes sensing a parameter indicative of the remaining moisture in the load of laundry. An RMC of the load of laundry can be determined using any suitable method and can be based on the output from the at least one sensor 114, by way of non-limiting example in the form of a moisture sensor. In another example, the RMC can be estimated based on readings of one or more moisture sensors in the form of conductivity strips. Another parameter that can be utilized is determining the mass of the load of laundry in the drum upon completion of the final extraction cycle 222.

If the RMC is equal to or less than a pre-determined amount the controller 106 initiates the drying phase 206. If the RMC is greater than the pre-determined amount, the controller 106 re-starts the intermediate phase 204. This loop is repeated until the desired RMC is reached, which is followed by the drying phase 206. The final extraction cycle 222 can be conducted with an extended plateau, or time period.

The drying phase 206 can include at 226 introducing the drying air 104 as already described herein to the treating chamber 18. It is further contemplated that the drying phase 206 can include a final RMC check 228 to ensure the load of laundry is sufficiently dry. The drying phase 206 can further include a tumbling cycle 230 in which the load of laundry is tumbled at low speeds to prevent wrinkling.

Figure 4:
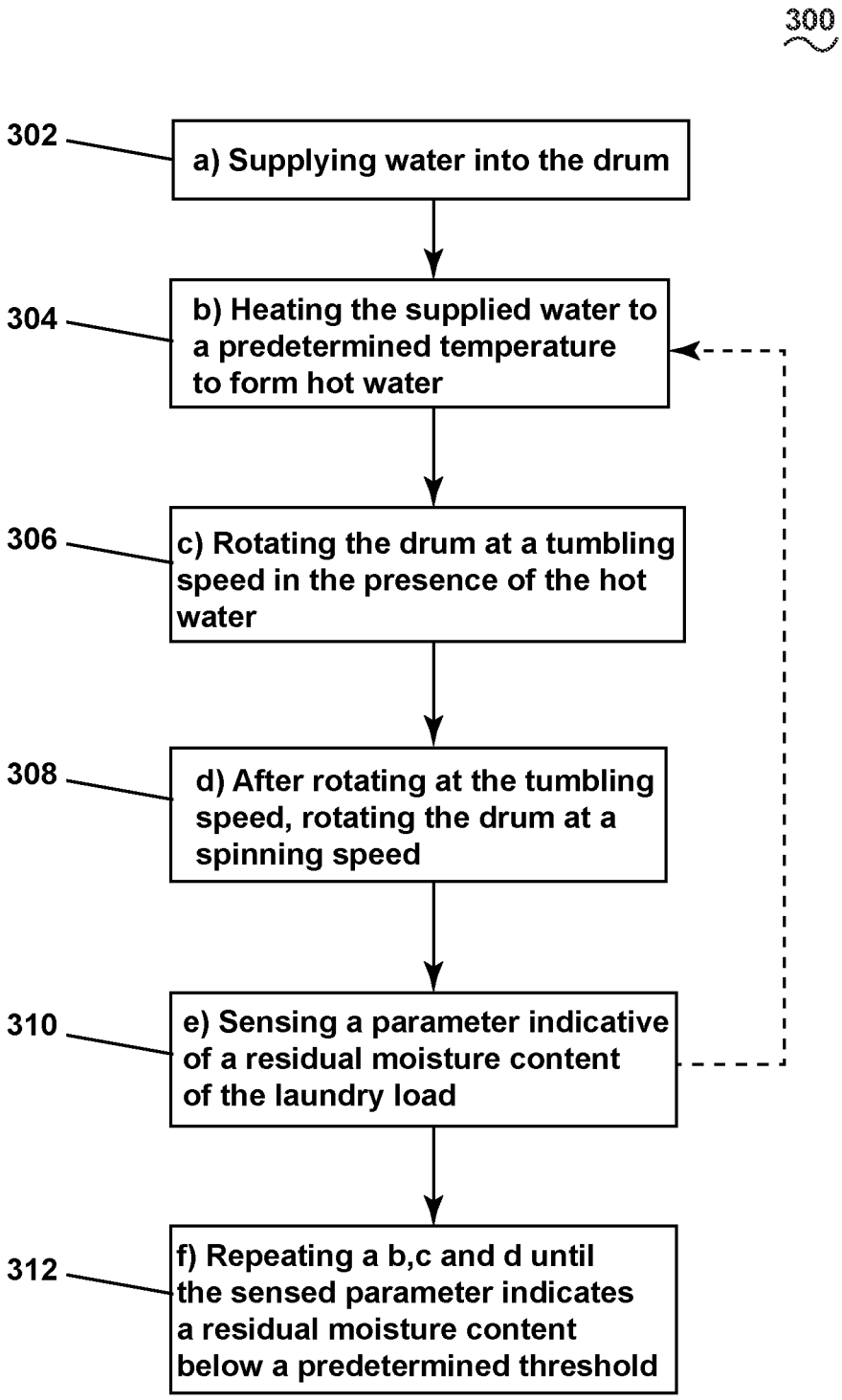
FIG. 4 is a flow diagram illustrating a method extracting liquid from a load of laundry in the laundry treating appliance of FIG. 1.

A method 300 of extracting liquid from a load of laundry residing in the rotating drum 16 is illustrated in FIG. 4. This method 300 can occur in full during the intermediate phase 204 described herein. It is further contemplated that the method 300 occurs at the end of a wash cycle for a standalone washing machine or at the beginning of a drying cycle for a standalone dryer. The method 300 includes at 302 supplying water into the drum 16. Supplying the water into the drum 16 can include spraying the water into the drum 16 via the spray nozzle 56 or immersing at least a portion of the drum 16 in the supplied water. The supplied water can be recirculated through the drum 16. At 304 the water is heated to a predetermined temperature to form hot water. It should be understood that heating of the water to form hot water can occur prior to supplying the water into the drum 16, after supplying the water into the drum 16, or while supplying the water into the drum 16. It should be further understood that recirculating the supplied water can include recirculating the hot water. The water can be heated with the steam generator 82 as described herein, or be directly supplied from a hot water source via the valve 42. At 306 rotating the drum at a tumbling speed enables the load of laundry to heat up in the presence of the hot water. At 308 the drum 16 undergoes spinning after the tumbling in order to extract the hot water from the load of laundry. Upon completion of spinning, the hot water can be drained from the drum 16. At 310 sensing a parameter indicative of the RMC of the load of laundry occurs as described herein. Sensing the parameter can occur while spinning the drum 16. At 312 repeating at least heating, tumbling, and spinning the drum 16 can occur until the sensed parameter indicates that the RMC has registered below the pre-determined RMC.

In the event repeating occurs, the method 300 can supplying a new batch of water to the drum 16. Furthermore, the method heating again and increasing the predetermined temperature to a higher temperature than the initial heating at 304. It is further contemplated that the spinning speed is increased when compared to the initial spinning speed at 308 in the event a repeat occurs.

The aspects disclosed herein provide an intermediate phase for method of operating a combination washing and drying machine. By introducing a hot rinse cycle, the RMC is significantly reduced when compared to a method of operation without the intermediate phase. Benefits associated with the disclosure herein include eliminating the problem of having an elevated remaining moisture content (RMC) of the load of laundry at the end of the wash phase before entering the drying phase. This can result in improvement in drying efficiency, reduction of cycle time, and reduction of energy consumption by the combination washing and drying machine.

To the extent not already described, the different features and structures of the various aspects can be used in combination with each other as desired, or can be used separately. That one feature can not be illustrated in all of the aspects is not meant to be construed that it cannot be, but is done for brevity of description. Thus, the various features of the different aspects can be mixed and matched as desired to form new aspects, whether or not the new aspects are expressly described.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects disclosed herein are not to be considered as limiting, unless expressly stated otherwise.

What is claimed is:

1. A method of extracting liquid from a laundry load during of operation of a wash cycle, the method comprising:

a) supplying water into a drum;

b) heating the supplied water to a predetermined temperature to form hot water;

c) rotating the drum at a tumbling speed in a presence of the hot water;

d) rotating the drum at a spinning speed in an extraction cycle to remove excess moisture from the load of laundry;

e) sensing a parameter indicative of a residual moisture content of the laundry load;

f) comparing the remaining moisture content value to a pre-determined remaining moisture content value; and g) repeating at least d), e) and f) until the sensed parameter indicates a residual moisture content below a predetermined threshold.

2. The method of claim 1, further comprising repeating at least b) and c) until the sensed parameter indicates a residual moisture content below a predetermined threshold.

3. The method of claim 1 wherein the supplying the water comprises at least one of spraying the water into the drum or immersing at least a portion of the drum in the supplied water.

4. The method of claim 1 wherein the supplying the water further comprises recirculating the water through the drum.

5. The method of claim 2 wherein the heating the supplied water comprises increasing the predetermined temperature for at least one of the repeating of at least b).

6. The method of claim 1 wherein the spinning speed is increased for at least one of the repeating of at least d).

7. The method of claim 1 wherein the repeating includes repeating a).

8. The method of claim 1 wherein a) occurs concurrently with b).

9. The method of claim 1 further comprising draining the hot water from the drum after the rotating at a spinning speed.

10. The method of claim 1 wherein the sensing a parameter comprises sensing a parameter indicative of a mass of the laundry in the drum.

11. The method of claim 1 wherein the sensing a parameter comprises sensing a conductivity of the laundry load.

12. A method of operating a laundry treating appliance with a treating chamber for treating a load of laundry the method comprising:

heating a water supply to a predetermined temperature to form a hot water rinse;

supplying the hot water rinse to the treating chamber during a hot rinse cycle;

rotating the treating chamber at a tumbling speed;

spinning the treating chamber in an extraction cycle to remove excess moisture from the load of laundry;

sensing a parameter indicative of a remaining moisture content value in the load of laundry;

comparing the remaining moisture content value to a pre-determined remaining moisture content value; and repeating the extraction cycle until the remaining moisture content value is less than the pre-determined remaining moisture content value.

13. The method of claim 12 further comprising repeating the hot rinse cycle and the extraction cycle until the remaining moisture content value is less than the pre-determined remaining moisture content value.

14. The method of claim 12 further comprising introducing drying air to the load of laundry during a drying phase in an event the remaining moisture content value is less than or equal to the pre-determined remaining moisture content value.

15. The method of claim 14 further comprising washing the load of laundry during a wash phase.

16. The method of claim 15 wherein the wash phase includes washing the load of laundry in a main wash cycle, rinsing the load of laundry in a rinse cycle, and spinning the load of laundry in a first extraction cycle.

17. The method of claim 12 wherein heating the water supply comprises increasing the predetermined temperature if the remaining moisture content value is greater than the pre-determined remaining moisture content value.

18. The method of claim 12 wherein spinning the treating chamber comprises increasing a spinning speed if the remaining moisture content value is greater than the pre-determined remaining moisture content value.

19. The method of claim 12 wherein the sensing a parameter comprises sensing a parameter indicative of a mass of the laundry in the drum.

20. The method of claim 12 wherein the sensing a parameter comprises sensing a conductivity of the laundry load.

* * * * *